US007267185B2

(12) United States Patent
Underwood et al.

(10) Patent No.: US 7,267,185 B2
(45) Date of Patent: Sep. 11, 2007

(54) BIT RETAINER SYSTEM

(75) Inventors: Lance D. Underwood, Cypress, TX (US); Ronald G. Schmidt, Tomball, TX (US)

(73) Assignee: Smith International, Inc., Houston, TX (US)

( * ) Notice: Subject to any disclaimer, the term of this patent is extended or adjusted under 35 U.S.C. 154(b) by 333 days.

(21) Appl. No.: 10/984,019

(22) Filed: Nov. 8, 2004

(65) Prior Publication Data

US 2006/0096787 A1 May 11, 2006

(51) Int. Cl.
*E21B 17/00* (2006.01)

(52) U.S. Cl. ..... 175/325.2; 175/325.1; 175/320; 175/294

(58) Field of Classification Search ..... 175/294, 175/320, 325.1, 325.2, 300
See application file for complete search history.

(56) References Cited

U.S. PATENT DOCUMENTS 5,065,827 A 11/1991 Meyers et al.
6,070,678 A * 6/2000 Pascale ..... 175/300
6,827,162 B2 * 12/2004 Fisher ..... 175/414
7,117,939 B1 * 10/2006 Hawley et al. ..... 166/99

* cited by examiner

*Primary Examiner*—David Bagnell
*Assistant Examiner*—Brad Harcourt
(74) *Attorney, Agent, or Firm*—Osha Liang, LLP

(57) ABSTRACT

A bit retainer system comprising a casing, a driver sub adapted to be disposed around a shank of a bit, and a bit retainer. The driver sub comprises a threaded connector, a threaded pin end configured to engage with the hammer case, and a stop. The bit retainer comprises a load carrying threaded connector configured to engage with the threaded connector of the driver sub, and a catch thread configured to retain the head of a bit to the system.

27 Claims, 7 Drawing Sheets

BIT RETAINER SYSTEM

BACKGROUND OF INVENTION

1. Field of the Invention

The invention relates generally to percussion bits. More specifically, the invention relates to a bit retention system that, in the event of bit breakage, retains the head of the bit for easier removal from the drilled hole.

2. Background Art

Percussion bit systems are often used in drilling or boring through the earth's surface. In a percussion bit system, a percussion hammer is used to drive the percussion bit into the ground using the reciprocating action of a piston to energize the bit.

FIG. 1 illustrates a conventional percussion bit assembly design 100 that does not include a bit retainer. The percussion bit assembly 100 comprises a hammer case 101 that connects to a lower end of a drill string (not shown) through a threaded pin connection 145. The lower end of the hammer case 101 is threadedly engaged with driver sub 102. A plurality of splines (not shown) disposed on the driver sub 102, engage a plurality of splines 115 disposed on the shank 112 of the hammer bit 110, and rotatatively drive the bit 110. The upper end of the hammer bit 110 includes a piston strike surface 148 and a foot valve, or blow tube, 147. The lower end of the hammer bit includes a head 111.

The hammer assembly includes a control tube 143 and an annular piston chamber 146. Pressurized air moves a piston 142 in a reciprocating motion inside the annular piston chamber 146. A check valve 144 is used to communicate between the control tube 143 and the drill string (not shown). The lower end of the piston 142 is adapted to strike the piston strike surface 148, thereby imparting kinetic energy to the bit 110.

Occasionally, the bit 110 may fail and crack across the shank 112 of the bit 110 during drilling. If this happens, the head 111 of the bit 110 is left in the hole and has to be retrieved later through a costly fishing operation. In fact, most conventional hammer bits comprise a fishing thread 140 formed into the head 111 of the bit 110 to facilitate retrieving a broken head 111 from a drilled hole.

A bit retainer 205, as shown in FIG. 2 can be used to retain the head 211 of a bit 210 to the hammer assembly. FIG. 2 shows a conventional bit retainer system 200 comprising a driver sub 202, a bit retainer 205, and a bit 210. U.S. Pat. No. 5,065,827 assigned to the assignee of the current invention, is an example of such a conventional bit retainer.

The driver sub 202 comprises a first outside diameter 233 and a second outside diameter 232, wherein the second outside diameter 232 is larger than the first outside diameter 233. An external shoulder 230 is formed by the two sections. The driver sub 202 is disposed around shank 212 of bit 210. A plurality of splines (not shown) on the inside diameter of the driver sub 202 engage a plurality of splines 215 on the outside diameter of the shank 212 and rotatively drive the bit 210.

A bit retainer 205 is disposed around the driver sub 202 and the bit 210. An internal shoulder 208 engages the bit retainer 205 with the driver sub 202. The pin end 203 of the driver sub 202 is threadedly connected with the hammer case 201. An upper shoulder 234 of the bit retainer 205 abuts the hammer case 201. The internal shoulder 208 between the bit retainer 205 and the driver sub 202 supports the axial load generated by tightening the driver sub 202 to the hammer case 201.

The bit retainer 205 further comprises a catch thread 207 on its lower end that, in the event that the bit 210 breaks in the shank 212 area, a retaining thread 213 on the bit 210 engages the catch thread 207. This prevents the head 211 of the bit 210 from separating from the percussion bit assembly.

The internal shoulder 208 provides an axial stop function and also serves as the primary load-carrying and torque-carrying mechanism. The inside diameter of the shoulder 208 must be slightly larger than the first outside diameter 233 of the driver sub 202 to allow the bit retainer 205 to pass over the driver sub 202 during assembly of the two components. The internal shoulder 208 must be large enough to support the axial load generated by the makeup of the system. The bit retainer 205 must have a greater diameter than that of the driver sub external shoulder 230 to allow the catch threads 207 at the lower end of the bit retainer 205 to pass over the shoulder 230 during assembly. The thickness of the bit retainer 205 must also be sufficient to support the axial load sustained when pulling a broken bit head out of the hole. In a conventional bit retainer, these considerations result in a system where the outside diameter of the bit retainer 205 is larger than the outside diameter of the drill string casing 201.

The drill bit 210 generates cuttings that are carried by drilling fluid past the bit retainer 205 and hammer case 201. The velocity of the drilling fluid and cuttings is greater around the bit retainer 205 than around the hammer case 201, because the bit retainer 205 is larger in diameter than the hammer case 201. This results in less flow area between the bit retainer 205 and the hole wall. The cuttings are abrasive and cause erosion of the bit retainer 205, limiting its useful life. Further, in sticky formations, the bit retainer 205 may impede cuttings from being removed from the bit 210 and carried further up the hole due to its larger diameter. It is therefore desirable to construct a system wherein the outside diameter of the bit retainer 205 is substantially similar to the outside diameter of the hammer case 201.

Typical dimensions for a conventional hammer and bit retainer are now provided to illustrate exemplary bits. No limitation on the scope of the invention is intended by any reference to any specific dimension. The major diameter 235 of the threaded pin end 203 of the driver sub 202 is approximately 6.250 in. for a 8¾ in. for a conventional hammer and bit retainer used in an 8¾ in. hole size. The bit retainer 205 must pass over this diameter as a clearance fit, so the designed inside diameter is approximately 6.310 in. It is customary to bevel sharp corners to prevent handling damage to parts and personnel, so a 45 degree by 0.070 in. chamfer is used. This brings the inside diameter of the shoulder 208 to 6.450 in. The mating shoulder 230 on the driver sub 202 is limited by the driver sub outside diameter 232, which is about 6.800 in. The shoulder 230 also has a 45 degree by 0.070 in. chamfer, so the actual driver sub shoulder 230 outside diameter is 6.660 in. The bit retainer shoulder 208 inside diameter and the driver sub shoulder 230 outside diameter define the contact area, which is 2.162 square inches. The yield strength of the bit retainer 205 is specified as 125,000 psi, and a commonly used design criteria for shoulder loading is 66% of yield strength. Therefore, the shoulder 208 is capable of sustaining about 178,365 lb. of load. Based on this load, and a thread lubricant friction coefficient of 0.080, the connection is limited to a makeup torque of about 11,000 ft.-lb. of torque. This value is about half that of the nearby connections in the hammer, and less that half the makeup torque of the connections in the drill string. As a result, the shoulder 208 is likely to crush when high torque is encountered during drilling.

The bit retainer 205 must pass over the driver sub outside diameter 232, so its minor diameter is 6.820 in. The channel 209 in the bit retainer inside diameter must be large enough to allow the bit retaining thread 213 to move freely in the channel 209 without contact. The major diameter 236 of the retaining thread 213 on the bit 210 is 6.984 in., so the channel inside diameter 237 is 7.00 in. The typical bit retainer outside diameter 238 is 7.625 in., which leaves a 5/16 in. wall thickness of the bit retainer 205 in the area of the channel 209.

The clearance between the bit retainer outside diameter and the wall of the 8¾ in. drilled hole is 0.562 in. per side, resulting in about 14.5 square inches of annular flow area. In deep hole drilling with this hole size, between 2400 and 4000 standard cubic feet per minute (SCFM) of fluid flow is typically used to operate the hammer and remove cuttings from the hole. Depending on the air flow rate and the abrasivity of the drilled cuttings, the life of a bit retainer may be limited to roughly fifty to two hundred operating hours due to the erosive action of the cuttings on the bit retainer. The outside diameter of the mating hammer case is 7.150 in., resulting in a hole wall clearance of 0.800 in. and an annular flow area of about 20 square inches. The air velocity past the hammer case is about 27% lower than air velocity past the bit retainer. As a result, hammer cases erode much less than bit retainers and have a longer useful life. It is, therefore, desirable to reduce the outside diameter of the bit retainer to thereby reduce air velocity and erosion. However, in reducing the outside diameter of a conventional bit retainer, either wall thickness or shoulder diameter must also be reduced. This reduction in either wall thickness or shoulder diameter reduces the strength and torque capability of the bit retainer.

SUMMARY OF INVENTION

In one aspect, the invention comprises a hammer case, a driver sub adapted to be disposed around a shank of a bit, and a bit retainer. The driver sub comprises a threaded connector, a threaded pin end configured to engage with the hammer case, and an axial stop. The axial stop is a shoulder cut into the threaded connector of the driver sub between the threaded pin end and the threaded connector. A bit comprises a head and a shank, the head having a retaining thread. The bit further comprises a plurality of splines disposed axially along the shank that are configured to engage a plurality of splines axially disposed on the inside diameter of the driver sub.

The bit retainer comprises a load carrying threaded connector configured to engage with the threaded connector of the driver sub, and a catch thread configured to retain the head of the bit to the system. The catch thread on the bit retainer is configured to thread past the threaded connector of the driver sub and the retaining thread on the head of the bit.

In another aspect, the invention comprises a hammer case, a driver sub adapted to be disposed around a shank of a bit, and a bit retainer. The driver sub comprises a threaded connector wherein an upper section is configured to engage the driver sub with the hammer case, and an axial stop. The axial stop is a shoulder cut into the threaded connector. A bit comprises a head and a shank, the head having a retaining thread. The bit further comprises a plurality of splines disposed axially along the shank that are configured to engage a plurality of splines axially disposed on the inside diameter of the driver sub.

The bit retainer comprises a load carrying threaded connector configured to engage with a lower section of the threaded connector of the driver sub, and a catch thread configured to retain the head of the bit to the system. The catch thread on the bit retainer is configured to pass over the threaded connector of the driver sub and the retaining thread on the head of the bit.

In another aspect, the invention comprises a hammer case, a driver sub adapted to be disposed around a shank of a bit, and a bit retainer. The driver sub comprises a threaded connector, a threaded pin end configured to engage with the hammer case, and a rotational stop provided by at least one locking device. The at least one locking device may comprise a key. A bit comprises a head and a shank, the head having a retaining thread. The bit further comprises a plurality of splines disposed axially along the shank that are configured to engage a plurality of splines axially disposed on the inside diameter of the driver sub.

The bit retainer comprises a load carrying threaded connector configured to engage with the threaded connector of the driver sub, a rotational stop configured to engage with the at least one locking device, and a catch thread configured to retain the head of the bit to the assembly. The catch thread on the bit retainer is configured to thread pass over threaded connector of the driver sub and the retaining thread on the head of the bit.

The bit retainer system further comprises a sealing device disposed around the driver sub and located axially between the at least one locking device and the load threaded connector. The sealing device may be an o-ring.

In another aspect, the invention comprises a hammer case, a bit having a head and a shank, a driver sub disposed around the shank, a bit retainer, and a sealing device disposed around the driver sub. The driver sub comprises a threaded connector, a threaded end configured to engage with the casing, and a stop. The driver sub comprises a load carrying threaded connector, a threaded end configured to engage with the casing, and an axial stop. The stop is provided by at least one locking device wherein the at least one locking device comprises a locking collar integrally formed with at least one key. The bit further comprises a retainer thread on the head. The bit further comprises a plurality of splines disposed axially along the shank that are configured to engage a plurality of splines axially disposed on the inside diameter of the driver sub.

The bit retainer comprises a load carrying threaded connector configured to engage with the threaded connector of the driver sub, and a catch thread configured to retain the head of the bit to the assembly. The catch thread on the bit retainer is configured to pass over the threaded connector of the driver sub and the retaining thread on the head of the bit.

The sealing device of the bit retainer system is axially disposed between the axial stop and the load carrying threaded connector. The sealing device maybe be an o-ring.

Other aspects and advantages of the invention will be apparent from the following description and the appended claims.

DETAILED DESCRIPTION

When using a hammer drill, the percussion bit occasionally breaks and the bit head may become separated from the assembly. A significant problem may occur if the bit head is lost into the hole. Thus, a bit retainer may be used so that the broken bit can be retrieved from the hole with the assembly. In one aspect, embodiments of the present invention relate to a bit retainer.

Select embodiments of the present invention, as described below, include a threaded connection between a bit retainer and a driver sub in a bit retainer system. The threaded connection between the driver sub and the bit retainer is the primary load carrying mechanism of the axial load of the system generated by the tightening of the driver sub and bit retainer assembly to the hammer case. This bit retainer system design found in select embodiments also provides the bit retainer with an outside diameter substantially similar to the outside diameter of the casing. In select embodiments, a shoulder is cut into the driver sub, the shoulder functioning as an axial stop when threading the driver sub and the bit retainer together. The shoulder size is reduced as compared to the size of conventional shoulders because the shoulder cut into the driver sub provides only an axial stop when threading the bit retainer and the driver sub. In other words, the shoulder is not the primary load carrying mechanism for the axial load of the system, and can therefore be reduced in size. In other embodiments, the shoulder is eliminated entirely and its function is replaced by other stop means, such as keys. Thus, the outside diameter of the bit retainer can be reduced, while maintaining the ability of the bit retainer to sustain axial loads generated by driver sub makeup and by pulling a broken bit head out of the drilled hole.

Figure 1:
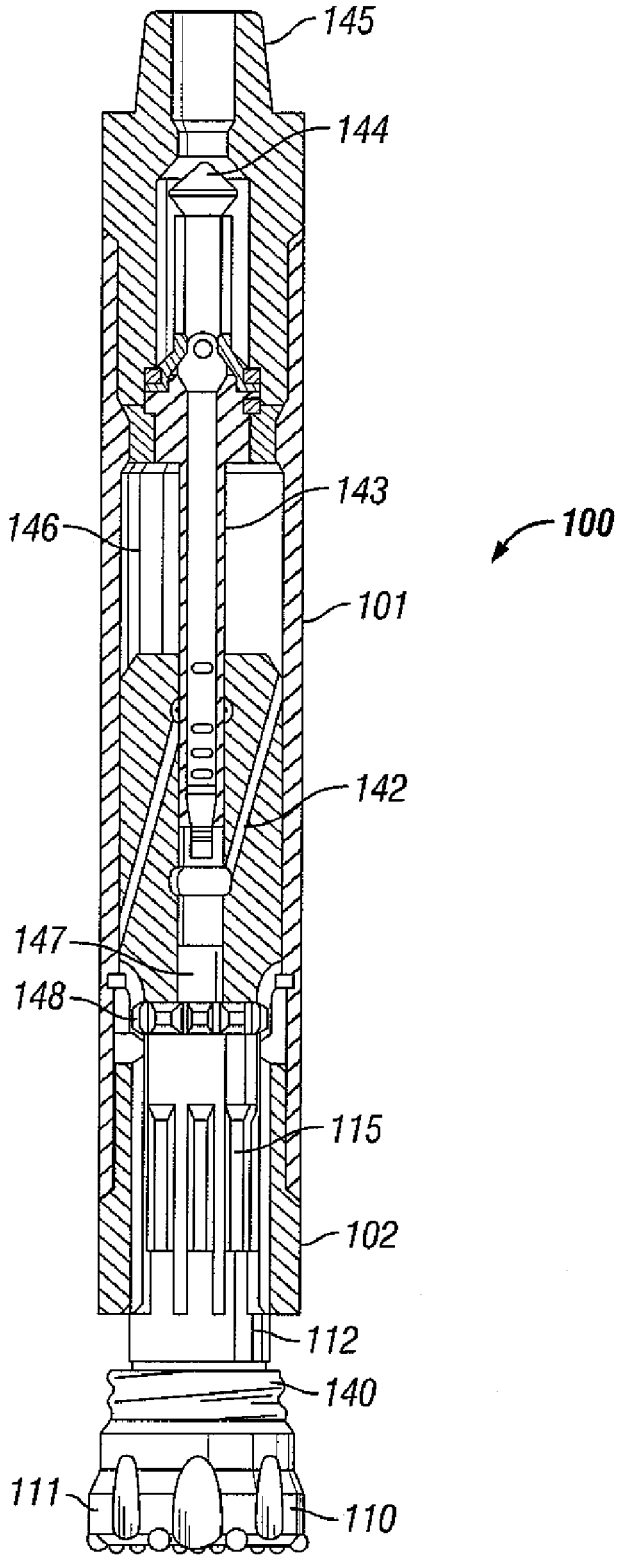
FIG. 1 (Prior Art)
FIG. 1 shows a cross-sectional view of a conventional hammer bit system design.
Figure 2:
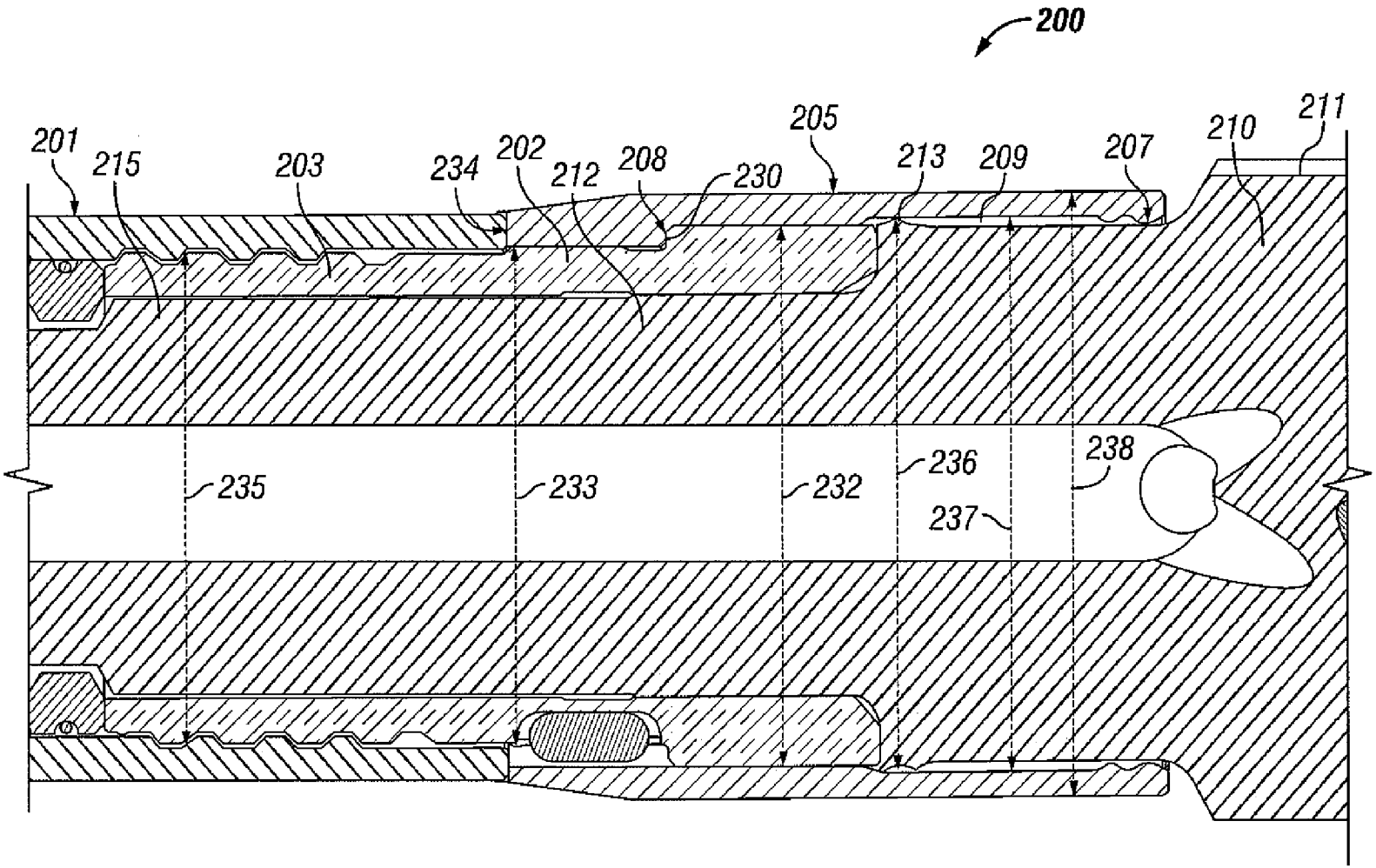
FIG. 2 (Prior Art)
FIG. 2 shows a cross-sectional view of another conventional hammer bit system design.
Figure 3:
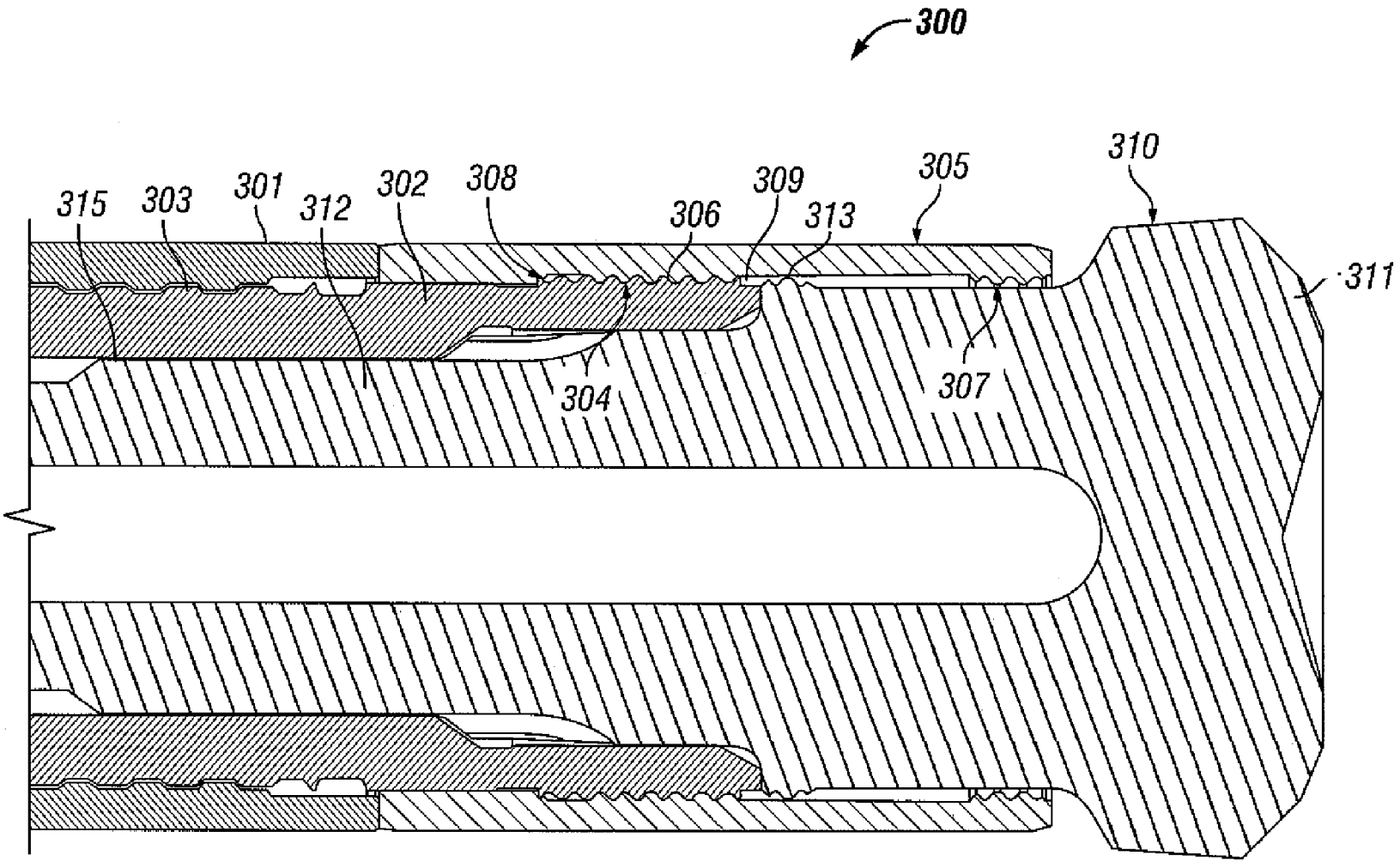
FIG. 3 shows a cross-sectional view of one embodiment of the bit retainer system of the current invention.

FIG. 3 shows a bit retainer system 300, in accordance with an embodiment of the invention. The bit retainer system 300 includes a hammer bit 310 inserted inside a driver sub 302. A plurality of splines (not shown) on the inside diameter of the driver sub 302 engage a plurality of splines 315 disposed axially on the outside diameter of shank 312, and rotatively drive the bit 310. A bit retainer 305 is threaded over the driver sub 302. A catch thread 307 on the bit retainer 305 is configured to thread past a threaded connector 304 on the driver sub 302 and a retaining thread 313 of the bit 310.

In this embodiment, an axial stop 308 on the driver sub 302 is a shoulder cut into the threaded connector 304. A load carrying threaded connector 306 on the bit retainer 305 is threaded with the threaded connector 304 on the driver sub 302 until the axial stop shoulder 308 is contacted. The connection between the load carrying threaded connector 306 on the bit retainer 305 and the threaded connector 304 on the driver sub 302 supports the axial load of the system generated by engaging a threaded pin end 303 of the driver sub 302 inside the hammer case 301 and by engaging the bit retainer 305 with the driver sub 302. A circumferential channel 309 disposed on the inside diameter of the bit retainer 305, between the load carrying threaded connector 306 and the catch thread 307, allows the bit to travel axially as required for normal hammer operation.

The catch thread 307 of the bit retainer 305 acts as a "bit catch." In the event that the drill bit 310 breaks in the shank 312, the retaining thread 313 will shoulder on the catch thread 307 as the bit head 311 falls. The bit retainer 305 thus retains the bit head 311 to the bit retainer system 300, allowing for easier removal of a broken bit 310.

Figure 4:
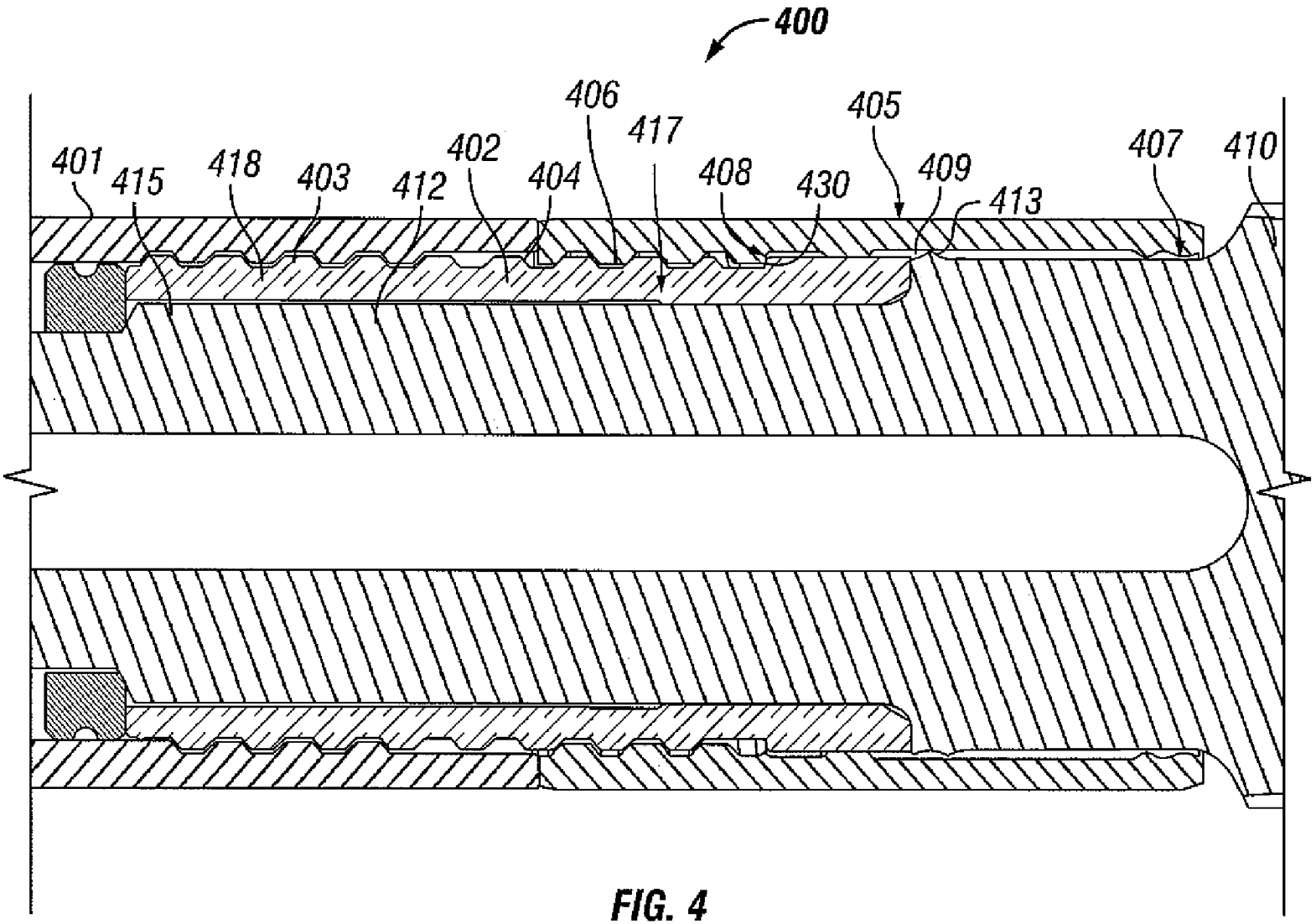
FIG. 4 shows a cross-sectional view of another embodiment of the bit retainer system of the current invention.

FIG. 4 shows another embodiment of the invention. In this embodiment, a bit retainer system 400 includes a hammer bit 410 inserted inside a driver sub 402. A plurality of splines (not shown) on the inside diameter of the driver sub 402 engage a plurality of splines 415 on the outside diameter of shank 412, and rotatively drive the bit 410. The driver sub 402 has a threaded connector 404, which has an upper section 403 and a lower section 417. A bit retainer has a threaded connector 406 and a catch thread 407. A bit 410 comprises a head 411 having a retaining thread 413. The catch thread 407 on the bit retainer 405 is configured to pass over the outside diameter of the driver sub 402 and thread past the retaining thread 413 of the bit 410. The upper section 403 of the threaded connector 404 is configured to attach to a hammer case 401.

In this embodiment, an axial stop 408 is provided by is a shoulder 430 formed on the driver sub 402 adjacent to the threaded connector lower section 417. A mating axial stop 408 is formed into the load carrying threaded connector 406 of the bit retainer 405. The bit retainer 405 is assembled onto the driver sub by threading the load carrying threaded connector 406 past the upper section 403 of the threaded connector 404 and onto the lower section 417 until the bit retainer axial stop shoulder 408 contacts the driver sub axial stop shoulder 430. Simultaneously, the bit retainer catch thread 407 is threaded past the bit retaining thread 413. The upper section 403 of the threaded connector 404 is engaged with the hammer case 401. The threaded connection between the load carrying threaded connector 406 on the bit retainer 405 and the lower section 417 on the driver sub 402 supports the axial load of the system generated by engaging the upper section 403 of the threaded connector 404 of the driver sub 402 inside the hammer case 401. A circumferential channel 409 disposed on the inside diameter of the bit retainer 405, between the load carrying threaded connector 406 and the catch thread 407, allows the bit to travel axially as required for normal hammer operation.

The catch thread 407 of the bit retainer 405 acts as a "bit catch." In the event that the drill bit 410 breaks in the shank 412, the retaining thread 413 will shoulder on the catch thread 407 as the bit head 411 falls. The bit retainer 405 retains the bit head 411 to the bit retainer system 400, allowing for easier removal of a broken bit 410.

Figure 5:
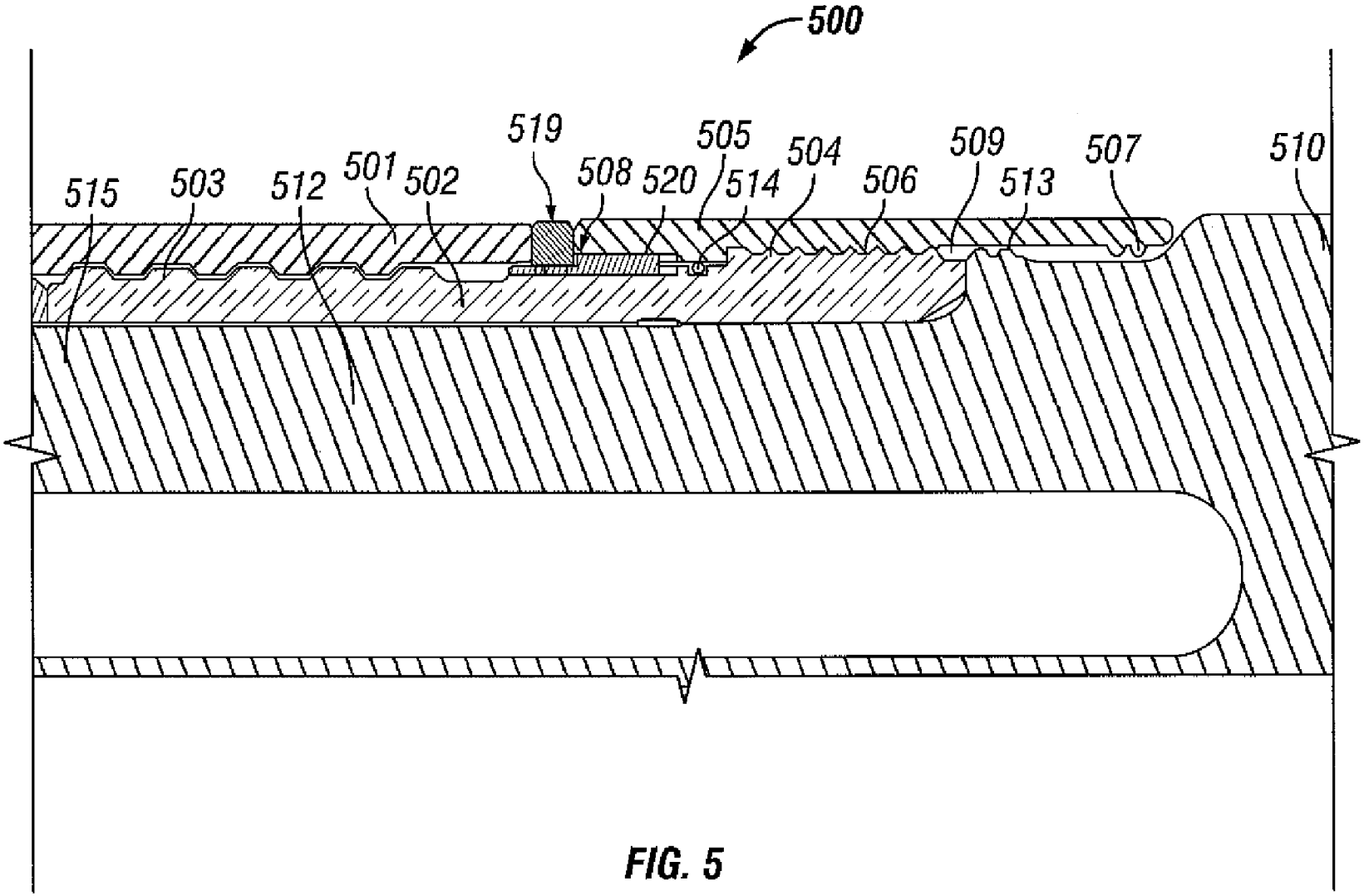
FIG. 5 shows a cross-sectional view of another embodiment of the bit retainer system of the current invention.

FIG. 5 shows another embodiment of the bit retainer system of the current invention. The bit retainer system 500 includes a hammer bit 510 inserted inside a driver sub 502. A plurality of splines (not shown) on the inside diameter of the driver sub 502 engage a plurality of splines 515 on the outside diameter of shank 512, and rotatively drive the bit 510. A bit retainer 505 is threaded over the driver sub 502. A catch thread 507 on the bit retainer 505 is configured to pass over a threaded connector 504 of the driver sub 502 and a retaining thread 513 of the bit 510.

A load carrying threaded connector 506 on the bit retainer 505 is threaded with the threaded connector 504 on the driver sub 502. In this embodiment, a stop 508 is provided by at least one locking device 520, for example at least one key, inserted between the bit retainer 505 and the driver sub 502. Alternatively, other locking devices such as pins or balls could be used. A locking collar 519 may be disposed around the driver sub 502 and abut the at least one locking device 520. The locking collar 519 secures the at least one locking device 520 between the driver sub 502 and the bit retainer 505. The at least one locking device 520 supports a substantial portion of the torque of the system, allowing the load carrying threaded connector 506 of the bit retainer 505 to carry primarily axial load as opposed to additionally carrying torque. The connection between the load carrying threaded connector 506 on the bit retainer 505 and the threaded connector 504 on the driver sub 502 supports the axial load of the system generated by engaging the threaded pin end 503 of the driver sub 502 inside a hammer case 501. A circumferential channel 509 disposed on the inside diameter of the bit retainer 505, between the load carrying threaded connector 506 and the catch thread 507, allows the bit to travel axially as required for normal hammer operation.

A sealing device 514 may be disposed on the outside diameter of the driver sub 502 in an location axially between the locking devices 508 and the threaded connector 504 of the driver sub 502. The sealing device 514 may be any known in the art, such as an o-ring. The sealing device 514 prevents pressure pulses from blowing out the lubrication between the engaged load carrying threaded connector 506 on the bit retainer 505 and the threaded connector 504 on the driver sub 502. The sealing device prevents gouging of the threads that can occur when there is insufficient lubrication between the threads.

The catch thread 507 of the bit retainer 505 acts as a "bit catch." In the event that the drill bit 510 breaks in the shank 512, the retaining thread 513 will shoulder on the catch thread 507 as the bit head 511 falls. The bit retainer 505 retains the bit head 511 to the bit retainer system 500, allowing for easier removal of a broken bit 510.

Figure 6:
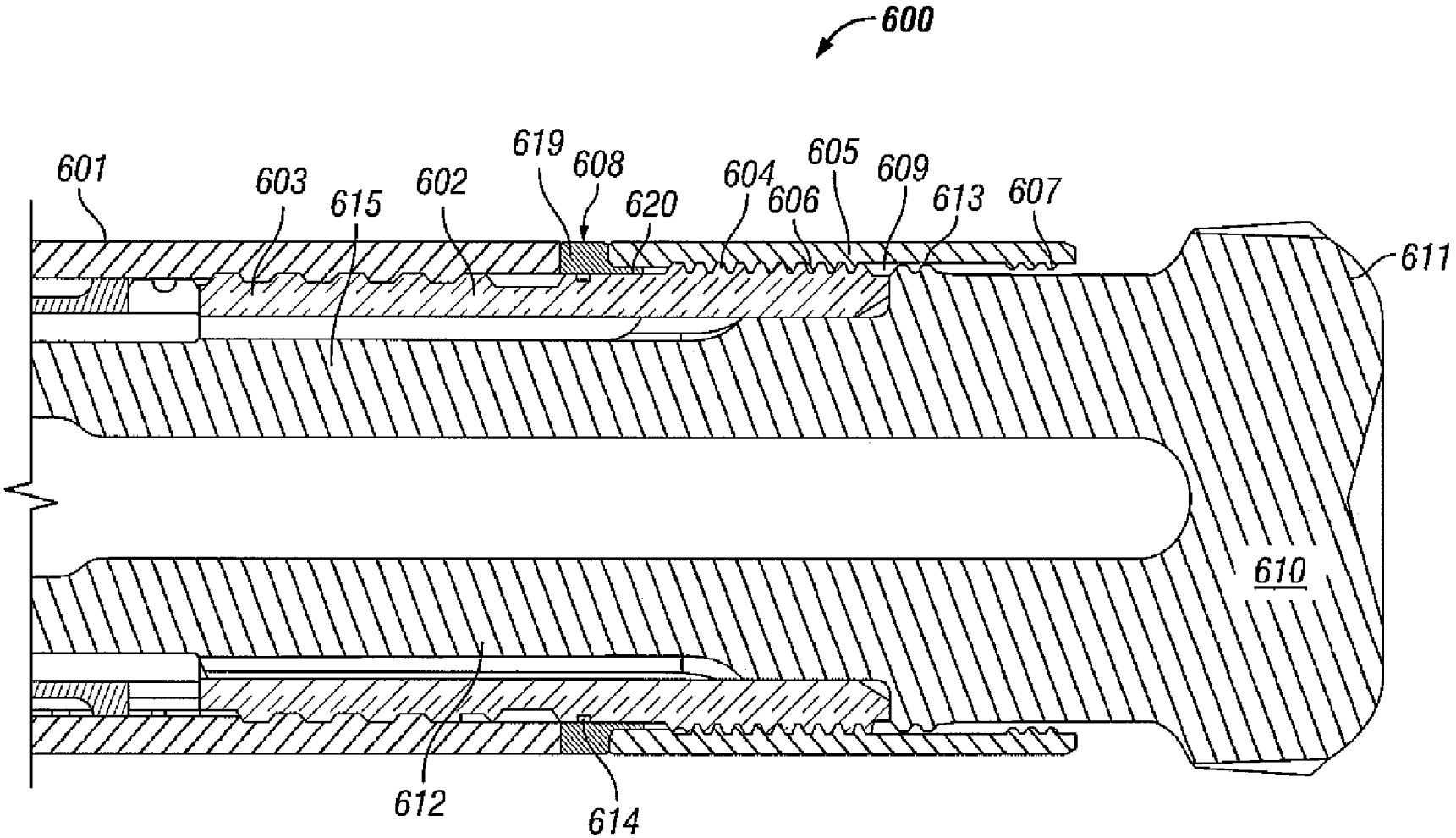
FIG. 6 shows a cross-sectional view of another embodiment of the bit retainer system of the current invention.

FIG. 6 shows another embodiment of the present invention. The bit retainer system 600 includes a hammer bit 610 inserted inside a driver sub 602. A plurality of splines (not shown) on the inside diameter of the driver sub 602 engage a plurality of splines 615 on the outside diameter of shank 612, and rotatively drive the bit 610. A bit retainer 605 is threaded over the driver sub 602. A catch thread 607 on the bit retainer 605 is configured to pass over a threaded connector 604 on the driver sub 602 and a retaining thread 613 of the bit 610.

In this embodiment, a rotational stop 608 is provided by a locking device that comprises a locking collar 619 integrally formed with at least one key 620. The locking collar 619 is disposed around the driver sub 602, and the at least one key 620 formed on the locking collar 619 is inserted between the driver sub 602 and the bit retainer 605. The threaded connector 604 of the driver sub 602 is threaded with the load carrying threaded connector 606 on the bit retainer 605. The keys 620 of the locking collar 619 transmit a substantial portion of system torque between the driver sub 602 and the bit retainer 605. The connection between the load carrying threaded connector 606 on the bit retainer 605 and the threaded connector 604 on the driver sub 602 supports the axial load of the system generated by engaging the threaded end 603 of the driver sub 602 inside a hammer case 601. A circumferential channel 609 disposed on the inside diameter of the bit retainer 605, between the load carrying threaded connector 606 and the catch thread 607, allows the bit to travel axially as required for normal hammer operation.

A sealing device 614 may be disposed on the outside diameter of the driver sub 602 in a location axially between the stop 608 and the threaded connector 604. The sealing device 614 may be any known in the art, such as an o-ring. The sealing device 614 prevents pressure pulses from blowing out the lubrication between the load carrying threaded connector 606 and the threaded connector 604. The sealing device prevents gouging of the threads that can occur when there is insufficient lubrication between the threads.

The catch thread 607 of the bit retainer 605 acts as a "bit catch." In the event that the drill bit 610 breaks in the shank 612, the retaining thread 613 will shoulder on the catch thread 607 as the bit head 611 falls. The bit retainer 605 retains the bit head 611 to the bit retainer system 600, allowing for easier removal of the broken bit 610.

For illustrative purposes, a detailed example of an embodiment of the invention is provided in contrast to the detailed description of a conventional bit retainer system as described previously. Again, no limitation on the scope of the present invention is intended by referencing particular dimensions. Referring to an embodiment, as depicted in FIG. 6, the outside diameter of the bit retainer 605 for an 8¾ in. hole size is 7.150 in. The outside diameter of the hammer case 601 is also 7.150 in. The thread major diameter of the threaded connector 604 of the driver sub 602 is 6.555 in., and the mating load carrying threaded connector 606 on the bit retainer 605 is 6.395 in. The effective shoulder area of each thread is approximately 1.627 square inches, and approximately 8 threads are in contact. Therefore, the equivalent load carrying shoulder is approximately 13 square inches. This results in a load capacity of the system approximately 6 times the load carrying capacity of a conventional retainer system, which as noted above, has a shoulder area of only 2.162 square inches.

Figure 7:
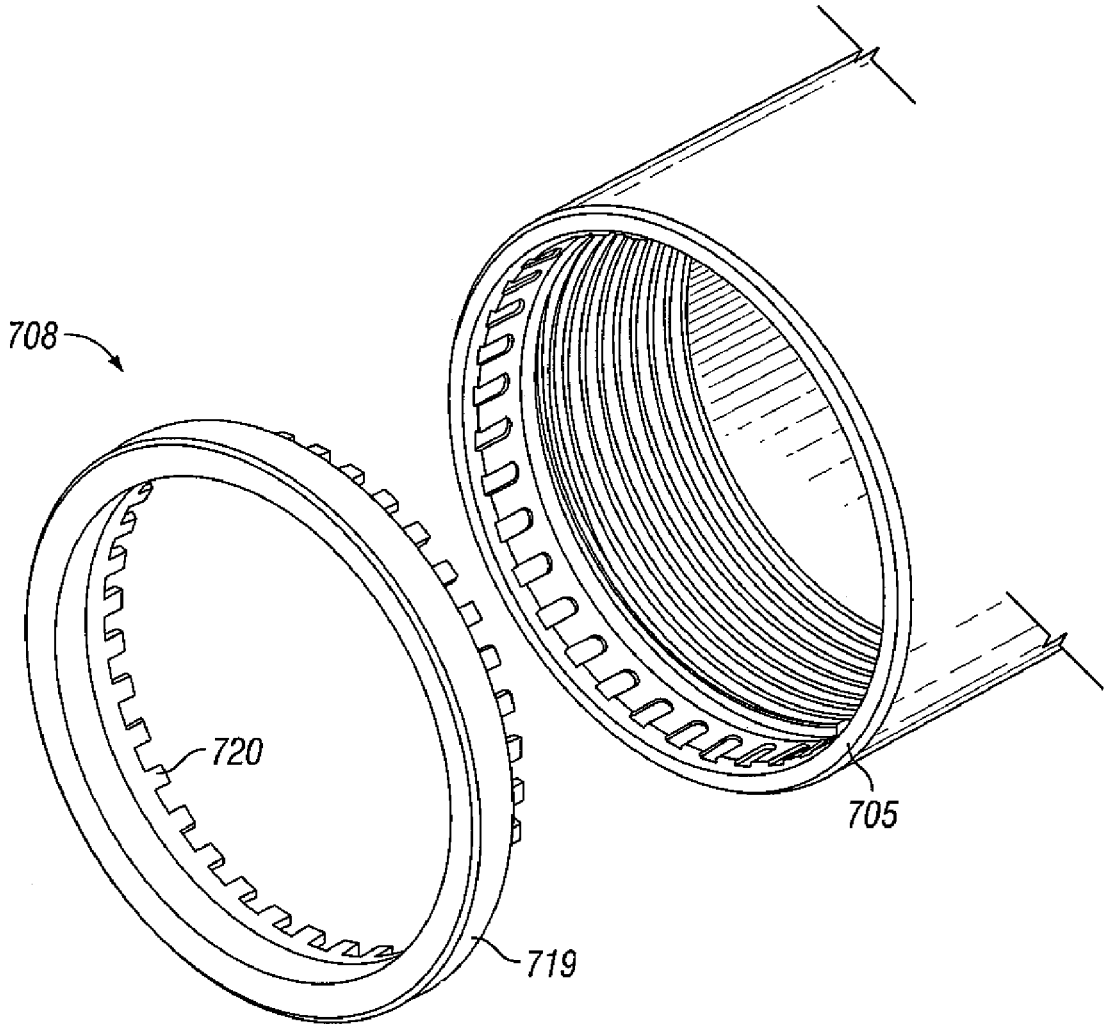
FIG. 7 shows a cross-sectional view of a component of an embodiment shown in FIG. 6.

Additionally, in an embodiment of the invention, a rotational stop 708 is provided by a locking collar 719, as detailed in FIG. 7, integrally formed with 36 keys 720, which are approximately ¼ in. wide by ¼ in. high. The locking collar is configured to engage the bit retainer 705 and the driver sub (602 in FIG. 6). The keys 720 alone can carry approximately 18,000 ft.-lb. of torque. When the threaded pin end 603, referring back to FIG. 6, of the driver sub 602 is made up to the hammer case 601 with a makeup torque of 25,000 ft.-lb., as is desired, the resulting axial load on the mating threaded connectors 604 and 606 is approximately 350,000 lb. Using this load value and a thread lubricant friction coefficient of 0.080, the threaded connectors 604 and 606 are capable of sustaining approximately 10,685 ft.-lb. of torque. Therefore, the combined torque carrying capacity of the keys 620 and the mating threaded connectors 604 and 606 is over 28,000 ft.-lb, whereas the conventional bit retainer system had a torque carrying capacity of only 11,000 ft.-lb., as calculated above.

While the above description uses "threads" to describe various features (e.g., catch thread and retaining thread) of embodiments of the invention, one of ordinary skill in the art would appreciate that these threads need not be continuous threads. Instead, these threads may comprise, for example, segments of the threads. Likewise, while the above description uses "keys" as an example of a locking device, one of ordinary skill in the art would appreciate that other similar locking devices, such as pins, balls, or splines may be used.

Embodiments of the invention may include one or more of the following advantages:

A bit retainer system with a threaded connection between the bit retainer and the driver sub that supports the axial load generated by the makeup of the system.

A bit retainer system with a locking device between the bit retainer and the driver sub, wherein the locking device transmits torque between the bit retainer and the driver sub.

A system where the outside diameter of the bit retainer is substantially similar to the outside diameter of the casing. This can improve hole cleaning, reduce retainer erosion, and prevent the system from getting stuck or hung up inside the bore hole.

A bit retainer with a thickness sufficient to endure the vibrations of the system due to the reciprocating action of the piston and the repeated impact of the bit on the drilling surface, and with sufficient thickness to sustain the load generated by pulling a broken bit head out of the drilled hole.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A bit retainer system comprising:
a hammer comprising a hammer case;
a bit having a head and a shank;
a driver sub adapted to be disposed around the shank of the bit, the driver sub comprising:
a threaded pin end configured to engage with the hammer case,
a threaded connector, and
an axial stop; and
a bit retainer comprising:
a load carrying threaded connector configured to engage with the threaded connector of the driver sub,
an axial stop, and
a catch thread configured to retain the head of the bit to the system,
wherein the catch thread on the bit retainer is configured to tread past the threaded connector of the driver sub.

2. The bit retainer system of claim 1, wherein the axial stop is a shoulder formed in the threaded connector.

3. The bit retainer system of claim 1, wherein the axial stop is a shoulder formed in the driver sub between the threaded pin end and the threaded connector.

4. The bit retainer system of claim 1, wherein a circumferential channel is disposed on the inside diameter of the bit retainer.

5. The bit retainer system of claim 1, wherein the head of the bit comprises a retaining thread.

6. The bit retainer system of claim 5, wherein the catch thread on the bit retainer is configured to thread past the retaining thread on the head of the bit.

7. The bit retainer system of claim 5, wherein the bit further comprises a plurality of splines disposed axially along the shank.

8. The retainer system of claim 7, wherein the plurality of splines on the shank are configured to engage a plurality of splines axially disposed on the inside diameter of the driver sub.

9. A bit retainer system comprising:
a hammer comprising a hammer case;
a bit having a head and a shank;
a driver sub adapted to be disposed around the shank of the bit, the driver sub comprising:
a threaded connector having an upper section, configured to engage the driver sub with the hammer case, and a lower section, and
an axial slop; and
a bit retainer comprising:
a load carrying threaded connector configured to engage with the lower section of the threaded connector of the driver sub, and
a catch thread configured to retain the head of the bit to the system,
wherein the catch thread on the bit retainer is configured to pass over the threaded connector of the driver sub.

10. The bit retainer system of claim 9, wherein the axial stop is a shoulder cut into the threaded connector.

11. The bit retainer system of claim 9, wherein a circumferential channel is disposed on the inside diameter of the bit retainer.

12. The bit retainer system of claim 9, wherein the head of the bit comprises a retaining thread.

13. The bit retainer system of claim 12, wherein the catch thread on the bit retainer is configured to thread past the retaining thread on the head of the bit.

14. The bit retainer system of claim 12, wherein the bit further comprises a plurality of splines disposed axially along the shank.

15. The retainer system of claim 14, wherein the plurality of splines on the shank are configured to engage a plurality of splines axially disposed on the inside diameter of the driver sub.

16. A bit retainer system comprising:
a hammer comprising a hammer ease;
a bit having a head and a shank
a driver sub adapted to be disposed around the shank of the bit, the driver sub comprising:
a threaded connector,
a threaded pin end configured to engage with the casing; and
a bit retainer comprising:
a load carrying threaded connector configured to engage with the threaded connector of the driver sub, and
a catch thread configured to retain the head of the bit to the assembly;
at least one locking device configured to engage the driver sub and the bit retainer; and
a sealing device disposed around the driver sub and located axially between the at least one locking device and the threaded connector.

17. The bit retainer system of claim 16, wherein the catch thread on the bit retainer is configured to pass over the threaded connector of the driver sub.

18. The bit retainer system of claim 16, wherein a channel is disposed on the inside diameter of the bit retainer.

19. The bit retainer system of claim 16, wherein the at least one locking device comprises a key.

20. The bit retainer system of claim 16, wherein the sealing device is an o-ring.

21. The bit retainer system of claim 16, wherein the head of the bit comprises a retaining thread.

22. The bit retainer system of claim 21, wherein the catch thread on the bit retainer is configured to thread past the retaining thread on the head of the bit.

23. The bit retainer system of claim 21, wherein the bit further comprises a plurality of splines disposed axially along the shank.

24. The retainer system of claim 23, wherein the plurality of splines on the shank are configured to engage a plurality of splines axially disposed on the inside diameter of the driver sub.

25. The bit retainer system of claim 19, further comprising a locking collar disposed around the driver sub and abutting the at least one locking device.

26. The bit retainer system of claim 19, wherein the at least one locking device comprises a locking collar integrally formed with at least one key.

27. The bit retainer system of claim 16, wherein the bit retainer further comprises a rotational stop configured to engage with the at least one locking device.

* * * * *

UNITED STATES PATENT AND TRADEMARK OFFICE

CERTIFICATE OF CORRECTION

PATENT NO. : 7,267,185 B2
APPLICATION NO. : 10/984019
DATED : September 11, 2007
INVENTOR(S) : Lance Underwood et al.

It is certified that error appears in the above-identified patent and that said Letters Patent is hereby corrected as shown below:

In the Claims:

In claim 9, column 10, line 1, the word "slop" should be --stop--.

In claim 16, column 10, line 28, the word "ease" should be --case--.

Signed and Sealed this

Eleventh Day of December, 2007

JON W. DUDAS
*Director of the United States Patent and Trademark Office*